US005271137A

United States Patent [19]

Schutz

[11] Patent Number: 5,271,137

[45] Date of Patent: Dec. 21, 1993

[54] METHOD OF FORMING A CORELESS PAPER ROLL PRODUCT

[75] Inventor: Rudolph W. Schutz, Walnut Creek, Calif.

[73] Assignee: James River paper Company, Inc., Richmond, Va.

[21] Appl. No.: 8,368

[22] Filed: Jan. 22, 1993

[51] Int. Cl.[5] ..... B31C 1/00; B31C 11/02; B26D 3/16; B65H 18/04

[52] U.S. Cl. ..... 29/400.1; 242/56.2; 83/54; 83/924; 82/47; 82/89; 493/288; 493/462

[58] Field of Search ..... 242/56 R, 56.2, 56 B, 242/67.1 R, 68; 83/54, 924; 82/47, 83, 89, 99.2, 101, 102; 493/288, 305, 306, 462; 29/400.1

[56] References Cited

U.S. PATENT DOCUMENTS

| | | | |
|---|---|---|---|
| 1,698,264 | 1/1929 | Hawkins . | |
| 1,817,996 | 8/1931 | Maltby . | |
| 2,312,550 | 3/1943 | Hornbostel | 82/47 |
| 2,623,443 | 12/1952 | Robinson . | |
| 2,767,459 | 10/1956 | Holman et al. . | |
| 2,845,231 | 7/1958 | Grettve | 242/56.6 |
| 3,252,387 | 5/1966 | Schur | 493/306 |
| 3,320,841 | 5/1967 | Judelson . | |
| 3,323,399 | 6/1967 | Gerstein et al. | 82/47 |
| 3,623,929 | 11/1971 | Wannamaker et al. | 493/288 |
| 3,748,934 | 7/1973 | Lezberg . | |
| 3,853,279 | 12/1974 | Gerstein | 242/56.2 |
| 4,152,958 | 5/1979 | Bogert . | |
| 4,216,686 | 8/1980 | Stoffels . | |
| 4,292,867 | 10/1981 | Stoffels et al. . | |
| 4,370,140 | 1/1983 | Fegley et al. . | |
| 4,487,378 | 12/1984 | Kobayashi . | |
| 4,713,992 | 12/1987 | Longuillat | 82/89 |

*Primary Examiner*—William E. Terrell
*Attorney, Agent, or Firm*—Thomas R. Lampe

[57] ABSTRACT

A coreless roll paper product is formed by a method which includes removing an elongated coreless paper roll from the end of a forming mandrel in intermittent steps and cutting the elongated coreless paper roll seriatim into coreless roll product segments with a saw blade located immediately adjacent to the mandrel end.

7 Claims, 1 Drawing Sheet

METHOD OF FORMING A CORELESS PAPER ROLL PRODUCT

TECHNICAL FIELD

This invention relates to a method of forming a coreless paper roll product, for example, a roll of tissue or toweling. More particularly, the method of the invention is concerned with the cutting of individual coreless roll product segments from an elongated coreless paper roll.

BACKGROUND ART

Many systems are known in the prior art for cutting elongated objects, including elongated rolls formed from web material, into sections or segments. A search conducted relative to the present invention, for example, located the following United States patents which are concerned with cutting or severing elongated objects such as rolls or tubes into shorter segments; U.S. Pat. No. 2,623,443, issued Dec. 30, 1952, U.S. Pat. No. 3,748,934, issued Jul. 31, 1973, U.S. Pat. No. 4,292,867, issued Oct. 6, 1981, U.S. Pat. No. 4,370,140, issued Jan. 25, 1983, U.S. Pat. No. 4,216,686, issued Aug. 12, 1980, U.S Pat. No. 4,152,958, issued May 8, 1979, U.S. Pat. No. 3,320,841, issued May 23, 1967, U.S. Pat. No. 2,767,459, issued Oct. 23, 1956, U.S. Pat. No. 1,817,996, issued Aug. 11, 1931, U.S. Pat. No. 1,695,264, issued Jan. 8, 1929 and U.S. Pat. No. 4,487,378, issued Dec. 11, 1984.

Some of the above-identified patents are worthy of special comment. U.S. Pat. No. 2,623,443 relates to the manufacture of helically wound tubes. The tubing is cut into length at preselected locations thereon as it comes off a mandrel, the cut being timed by a detector actuated by control marks on the strip forming the tubing. The tubing is relatively stiff and self supporting, characteristics much different than those found in coreless paper rolls. The patent pays no particular attention to the placement of the saw relative to the mandrel end and the saw follows along with the tubing in the same longitudinal direction during manufacture.

U.S. Pat. No. 4,292,867 provides for the cutting of webs disposed about a tubular core. The cuts are made along the length of the mandrel by a moveable saw carriage, a relatively expensive and complicated arrangement.

U.S. Pat. Nos. 4,216,686 and 4,152,958 disclose mechanisms for transversely slicing roll materials while they are on a mandrel. Such arrangements are not entirely satisfactory when dealing with relatively thin, fragile materials such as paper tissue and toweling.

It is also known to sever moving webs of paper toweling, tissue and the like lengthwise between a supply roll and a mandrel having a core of paperboard or plastic disposed thereabout, said core being pre-severed into lengths corresponding to the lengths of the finished products. Such an arrangement has its own attendant problems in that alignment between the severed web segments and core segments must be highly accurately maintained at all times. Then too, the system's use of numerous web segments or strips increases the chance of web breakage. In any event, such approaches are not applicable to the formation of coreless paper roll products.

U.S. Pat. No. 4,487,378 discloses the approach of forming an elongated coreless cant or log of paper (such as paper toweling or tissue) on a mandrel having a polygonal cross-section. According to the teachings of the patent, the elongated log is pulled end-wise from the mandrel once it has been formed. A circular saw arrangement then cuts the completely removed log or cant into individual towels or tissue rolls. A problem presents itself when utilizing this prior art approach since the saw crushes the center of the roll to some degree, resulting in distortion, or even virtual loss, of the polygonal opening through the center of the roll which was caused by, and corresponds to, the mandrel shape. This can make the rolls unsuitable for subsequent use on coreless roll holders.

DISCLOSURE OF INVENTION

The present invention relates to a method of forming a coreless paper roll product, such as tissue or toweling, which includes cutting the product from an elongated coreless paper roll in such a manner as to minimize disturbance of the central aperture of both the end product and the elongated coreless paper roll from which it is cut. The method of forming a coreless roll paper product according to the teachings of the present invention includes the step of winding a paper web about and directly onto an elongated mandrel having an end during rotation of the mandrel.

Rotation of the elongated mandrel is terminated after an elongated coreless paper roll having a predetermined outer diameter is formed by the wound convolutions of the paper web. The elongated coreless paper roll is severed from the web.

Next, the elongated coreless paper roll is extracted from the mandrel by relatively moving the elongated coreless paper roll and the mandrel. During the extracting step, the mandrel end is passed through the elongated coreless paper roll.

While passing the mandrel end through the elongated coreless paper roll, the elongated coreless paper roll is cut seriatim into coreless roll product segments at preselected locations on the elongated coreless paper roll after the coreless roll product segments are no longer disposed about the mandrel and the preselected locations are spaced and removed from the mandrel end.

According to the embodiment of the invention disclosed herein, the step of relatively moving the elongated coreless paper roll and the mandrel comprises relatively moving the elongated coreless paper roll and the mandrel in substantially uniform incremental stages, the degree of relative movement in each stage substantially corresponding to the length of the coreless roll product segments.

Relative movement between the elongated coreless paper roll and the mandrel is terminated with respect to each uniform incremental stage of relative movement immediately after one of the preselected locations is out of registry with the mandrel end and immediately adjacent thereto. The mandrel end provides support for the elongated coreless paper roll and the coreless roll product segment being cut therefrom during the cutting step at the predetermined location out of registration therewith and immediately adjacent thereto to resist collapse of the elongated coreless paper roll and the coreless roll product segment being cut therefrom during the cutting step.

The elongated coreless paper roll has an aperture extending therethrough, and the mandrel has a predetermined cross-sectional shape at the mandrel end. The shape of the aperture changes from a first configuration generally corresponding to the predetermined cross-sectional shape of the mandrel end to a second configuration differing from the first configuration as a result of forces exerted by the wound convolutions of the coreless roll product segment after the coreless roll product segment is withdrawn from the mandrel.

Each coreless roll product segment is cut from the elongated coreless paper roll at a preselected location when the shape of the aperture at the preselected location is intermediate the first and second configurations.

Other features, advantages, and objects of the present invention will become apparent with reference to the following description and accompanying drawings.

BEST MODE FOR CARRYING OUT THE INVENTION

Figure 1:
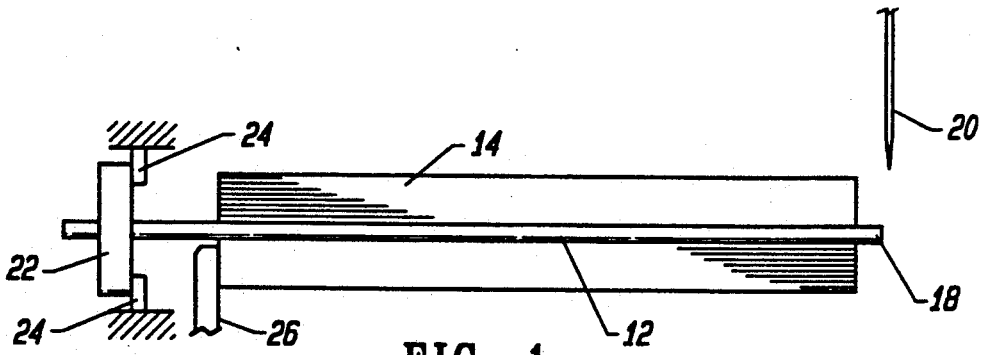
FIG. 1 is a schematic frontal view illustrating a mandrel and an elongated coreless paper roll wound thereabout.
Figure 1A:
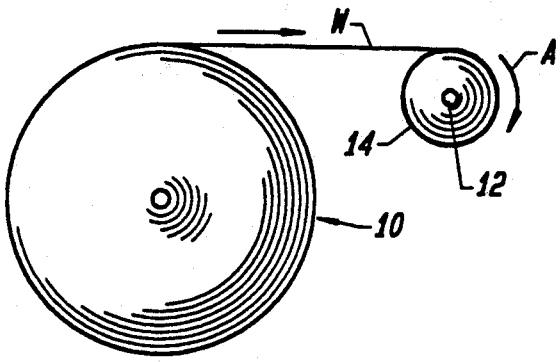
FIG. 1A is a schematic side view illustrating a paper web being wound about the mandrel and delivered from a parent roll.

FIG. 1A illustrates a parent or supply roll 10 furnishing a web W to a rotating elongated mandrel 12. For purposes of illustration, it will be assumed that the web W is paper tissue.

Rotation of the mandrel 12 in the direction of arrow A results in formation of an elongated coreless paper roll or cant 14. The paper web is wound directly about the mandrel and no intermediate core is provided.

Figure 1B:
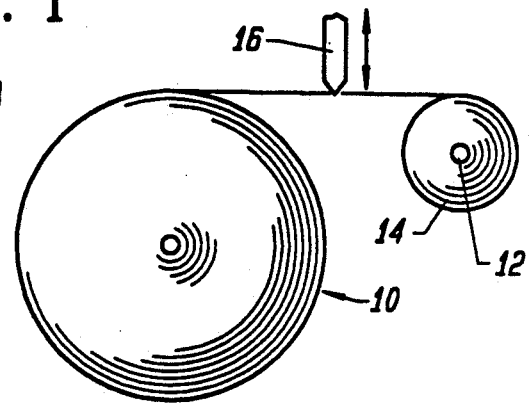
FIG. 1B is a view similar to FIG. 1A, but illustrating severing the paper web from the parent roll.

Rotation of the elongated mandrel 12 is terminated after the cant or log 14 attains a predetermined outer diameter formed by the wound convolutions of the paper web W. As illustrated in FIG. 1B, the elongated coreless paper roll 14 is severed from the rest of web W by a knife 16 brought into engagement with the web to cut same when the cant 14 attains the predetermined outer diameter.

FIG. 1 shows the formed elongated coreless paper roll 14 after formation thereof. It will be noted that mandrel 12 has an end 18. A saw blade of any suitable type and identified by reference numeral 20 is located adjacent to end 18. An enlargement 22 is affixed to the mandrel at the other end thereof. Enlargement 22 is adapted for engagement with stops 24 to limit movement of the mandrel in a longitudinal direction toward the right as viewed in FIG. 1.

Any suitable means may be employed to rotate mandrel 12. Since such rotation imparting means are well known in the prior art they are not shown or described. Moveable belts or rotating support rollers are commonly used, for example, to impart rotational movement to a mandrel and paper roll being formed thereabout.

Figure 2:
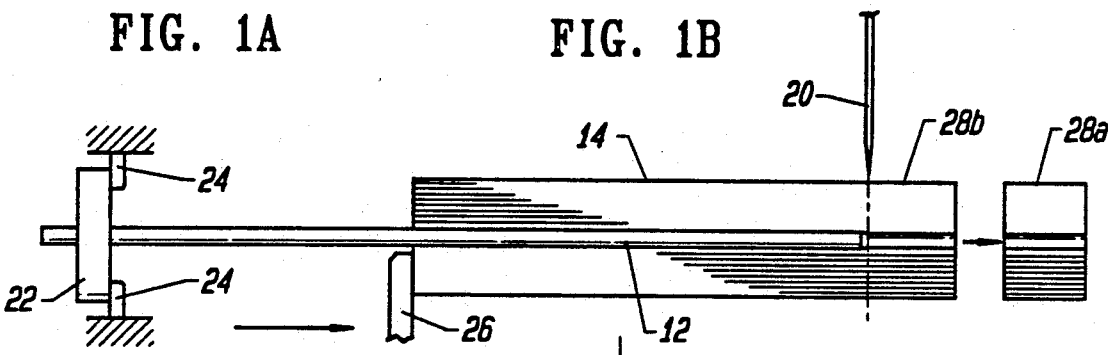
FIG. 2 is a view similar to FIG. 1, but illustrating the elongated coreless paper roll being moved relative to the mandrel with coreless roll product segments being cut from the elongated coreless paper roll.

After the elongated coreless paper roll 14 has been formed, it is extracted from the mandrel by relatively moving the elongated coreless paper roll and the mandrel. FIG. 2 illustrates one approach for accomplishing this wherein a pusher element 26 engages the end of cant 14 furthest removed from mandrel end 18. The engagement between enlargement 22 and stops 24 prevents the mandrel from moving to the right along with the cant or log 14 when it is being slid along the mandrel.

According to the teachings of the present invention, the elongated coreless paper roll is cut seriatim into coreless roll product segments at preselected locations on the elongated coreless paper roll after the coreless roll product segments are no longer disposed about the mandrel and the preselected locations are spaced and removed from the mandrel end. In FIG. 2 one product segment **28*a* is shown as already having been cut from the log or cant 14 while another coreless roll product segment 28*b* is shown in the position assumed thereby just prior to cutting of the coreless roll product segment 28*b*** from the log or cant.

It will be appreciated that the step of relatively moving the elongated coreless paper roll and the mandrel comprises relatively moving the elongated coreless paper roll and the mandrel in substantially uniform incremental stages, the degree of relative movement in each stage corresponding to the length of a coreless roll product segment. That is, the cant 14 is stripped from the mandrel in incremental steps with the relative movement stopping prior to engagement of the saw blade with the cant or log 14.

Figure 3:
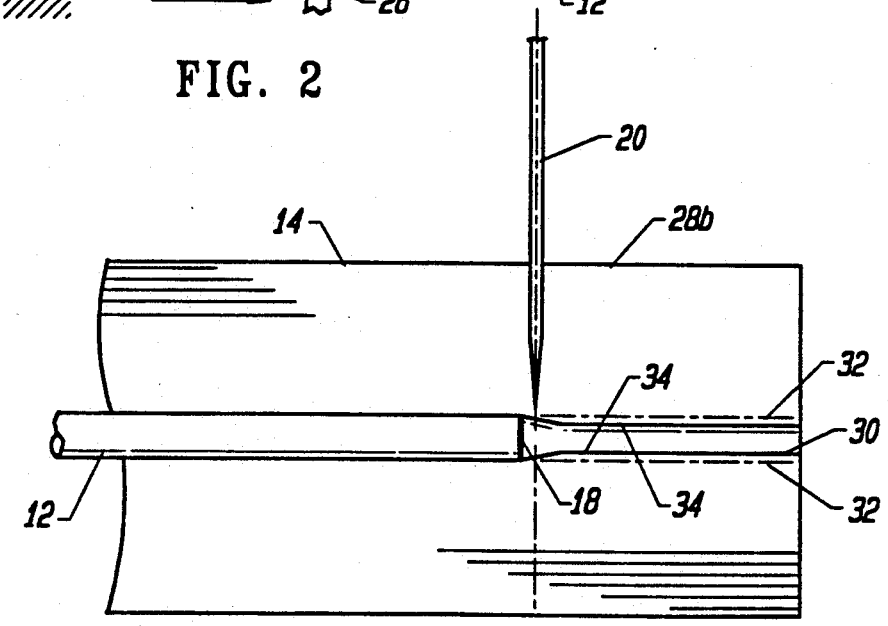
FIG. 3 is an enlarged, partial, schematic view illustrating the end of the mandrel, an elongated coreless paper roll projecting therefrom, and a saw cutting a coreless roll product segment from the elongated coreless paper roll.

Such positioning is quite critical, and FIG. 3 provides an illustration of the relative positions assumed by the elongated coreless paper roll 14, mandrel end 18, and saw blade 20 when the cutting step takes place. More particularly, relative movement between the elongated coreless paper roll 14 and the mandrel is terminated with respect to each uniform incremental stage of relative movement immediately after one of the preselected locations where a cut is to be made by saw 20 is out of registry with the mandrel end and immediately adjacent thereto. Utilizing this approach, the mandrel end will provide support for the elongated coreless paper roll 14 and the coreless roll product segment (in FIGS. 2 and 3, segment **28*b*) being cut therefrom. Such support will resist collapse of the elongated coreless paper roll 14** and the roll product segment being cut therefrom during the cutting step.

With further reference to FIG. 3, it will be noted that elongated coreless paper roll 14 has an aperture 30 extending therethrough. That portion of the aperture of elongated coreless paper roll 14 positioned on mandrel 18 has a configuration corresponding to the predetermined cross-sectional shape of the mandrel end. As the elongated coreless paper roll moves off and away from mandrel end 18, the cross-sectional configuration of the aperture 30 changes as a result of forces exerted by the wound convolutions of the coreless roll product segment **28*b*. This can clearly be seen in FIG. 3 wherein the portion of aperture 30 defined by segment 28*b* has become puckered under the forces exerted by the wound convolutions of segment 28*b* to provide indents 32 (depicted in phantom lines) and inwardly projecting ridges or detents 34. This configuration is, of course, representative only and will depend upon the circumstances; but in any event, the configuration of the aperture of the removed segment 28 will always differ in some respects from the configuration of the aperture when positioned on and about mandrel 12**.

Of course, the transition between aperture configurations does not occur immediately. That is, the shape of the aperture will gradually change or transition between the first and second configurations for some slight distance beyond the mandrel end 18. It is preferred that the cut severing a coreless roll product segment from the elongated coreless paper roll take place when the shape of the aperture at the preselected location of cut is intermediate the first and second configurations. This is illustrated in FIG. 3. With respect to conventional roll paper products such as roll towels or tissue rolls, the step of cutting should preferably take place when the preselected location of cut is spaced outwardly from the mandrel end a distance within a range of about 2 millimeters to about 10 millimeters.

The afore-described method results in a finished roll paper product which has a clearly defined aperture extending completely therethrough even though the product is coreless.

I claim:

1. A method of forming a coreless roll paper product, said method comprising the steps of:

winding a paper web about and directly onto an elongated mandrel having an end during rotation of said mandrel;

terminating rotation of said elongated mandrel after an elongated coreless paper roll having a predetermined outer diameter is formed by the wound convolutions of said paper web;

severing said elongated coreless paper roll from said web;

extracting said elongated coreless paper roll from said mandrel by relatively moving said elongated coreless paper roll and said mandrel;

during said extracting step, passing the mandrel end through said elongated coreless paper roll; and while passing the mandrel end through said elongated coreless paper roll, cutting said elongated coreless paper roll seriatim into coreless roll product segments at preselected locations on the elongated coreless paper roll after said coreless roll product segments are no longer disposed about said mandrel and said preselected locations are spaced and removed from said mandrel end.

2. The method according to claim 1 wherein the step of relatively moving said elongated coreless paper roll and said mandrel comprises relatively moving the elongated coreless paper roll and said mandrel in substantially uniform incremental stages, the degree of relative movement in each stage substantially corresponding to the length of the coreless roll product segments.

3. The method according to claim 2 wherein relative movement between the elongated coreless paper roll and the mandrel is terminated with respect to each uniform incremental stage of relative movement immediately after one of said preselected locations is out of registry with said mandrel end and immediately adjacent thereto whereby the mandrel end will provide support for said elongated coreless paper roll and the coreless roll product segment being cut therefrom during said cutting step at the predetermined location out of registration therewith and immediately adjacent thereto to resist collapse of the elongated coreless paper roll and the coreless roll product segment being cut therefrom during said cutting step.

4. The method according to claim 2 wherein said step of relatively moving said elongated coreless paper roll and said mandrel is carried out by pushing said elongated coreless paper roll to slide said elongated coreless paper roll incrementally along said mandrel.

5. The method according to claim 1 wherein said elongated coreless paper roll has an aperture extending therethrough, and wherein said mandrel has a predetermined cross-sectional shape at said mandrel end, the shape of said aperture changing from a first configuration generally corresponding to the predetermined cross-sectional shape of said mandrel end to a second configuration differing from said first configuration and resulting from forces exerted by the wound convolutions of said coreless roll product segment after said coreless roll product segment is withdrawn from said mandrel.

6. The method according to claim 5 wherein each said coreless roll product segment is cut from said elongated coreless paper roll at a preselected location when the shape of the aperture at said preselected location is intermediate said first and second configurations.

7. The method according to claim 3 wherein said cutting step is carried out when said preselected locations are spaced away from said mandrel end a distance within a range of from about 2 millimeters to about 10 millimeters.

* * * * *